United States Patent [19]

Kent

[11] 4,048,841

[45] Sept. 20, 1977

[54] FORMING APPARATUS

[75] Inventor: Anthony John Kent, Arbroath, Scotland

[73] Assignee: Matrix Engineering Limited, Scotland

[21] Appl. No.: 573,301

[22] Filed: Apr. 30, 1975

[30] Foreign Application Priority Data

May 1, 1974 United Kingdom ..... 19168/74

[51] Int. Cl.[2] ..... B21J 9/18

[52] U.S. Cl. ..... 72/450; 72/455

[58] Field of Search ..... 72/450, 456, 449, 455; 100/282; 74/571 R

[56] References Cited

U.S. PATENT DOCUMENTS

| | | | |
|---|---|---|---|
| 1,052,082 | 2/1913 | Miltner | 100/282 |
| 2,321,325 | 6/1943 | Sherman | 100/282 |
| 2,532,320 | 12/1950 | Maussnest | 100/282 |
| 2,891,497 | 6/1959 | Treer | 72/450 |
| 2,970,485 | 2/1961 | Frank | 100/282 |
| 3,375,730 | 4/1968 | Antonenko | 74/571 R |
| 3,508,430 | 4/1970 | Edmondson | 72/450 |
| 3,858,432 | 1/1975 | Voorhees | 72/450 |

*Primary Examiner*—C.W. Lanham

*Assistant Examiner*—Gene P. Crosby

*Attorney, Agent, or Firm*—Watson, Cole, Grindle & Watson

[57] ABSTRACT

Forming apparatus such as a press which includes a support or base having a bed which carries a crosshead mechanism. The crosshead mechanism is movable for reciprocation with respect to the bed in order to bring together co-operating parts of the form or press tooling respectively carried by the bed and crosshead mechanism. The crosshead mechanism is guided for such reciprocation relative to the support structure by a linear hydrostatic bearing mechanism and is driven by a pair of connecting rods coupled to corresponding spaced apart and axially aligned crankpins of a single crankshaft. Rotary hydrostatic bearing mechanisms are provided at both ends of the connecting rod for coupling it to the crankshaft and to the crosshead mechanism. The coupling of each connecting rod to its crankpin of the crankshaft is preferably accomplished through a bush mounted about a crankpin which in turn is mounted on the crankshaft. The bush is preferably eccentrically carried by the crankpin and is angularly adjustable thereabout for obtaining adjustment in the extent of reciprocation of the crosshead mechanism.

7 Claims, 5 Drawing Figures

FORMING APPARATUS

The object of this invention is to provide an improved construction of forming apparatus or press for producing formed metal or other parts or pressings to a high degree of accuracy. Practical advantages in this and other respects will be apparent from the following disclosure.

Figure 1:
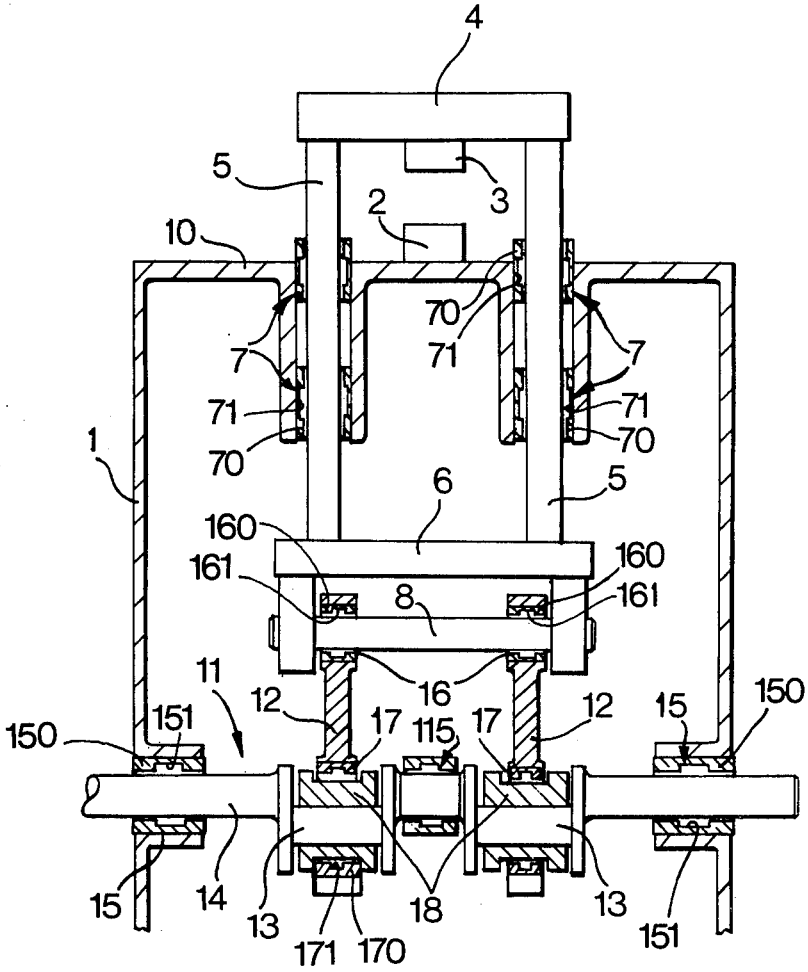
Figure 2:
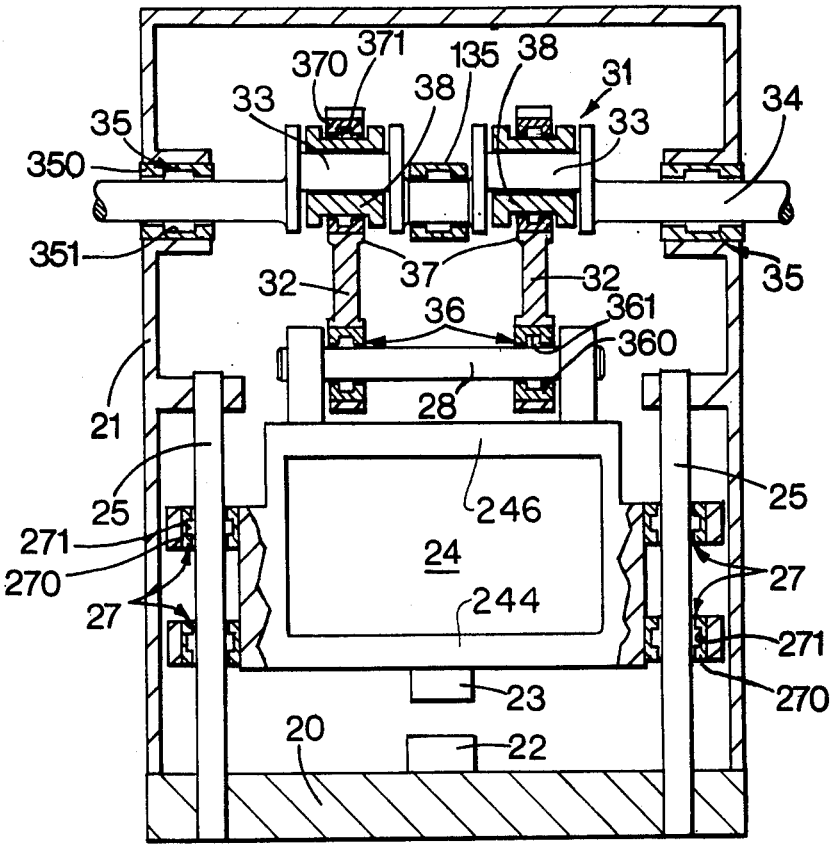
Figure 3:
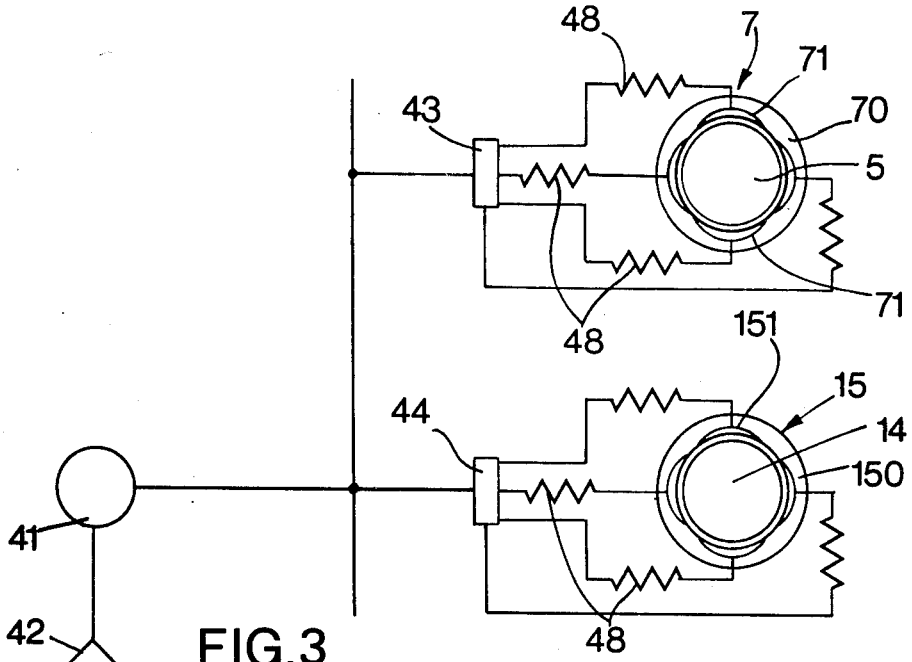
Figure 4:
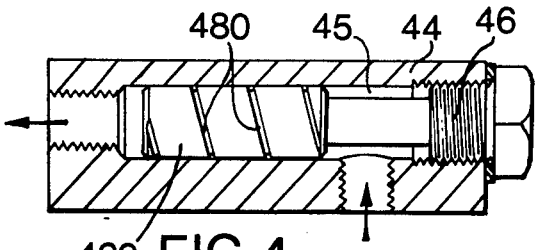
Figure 5:
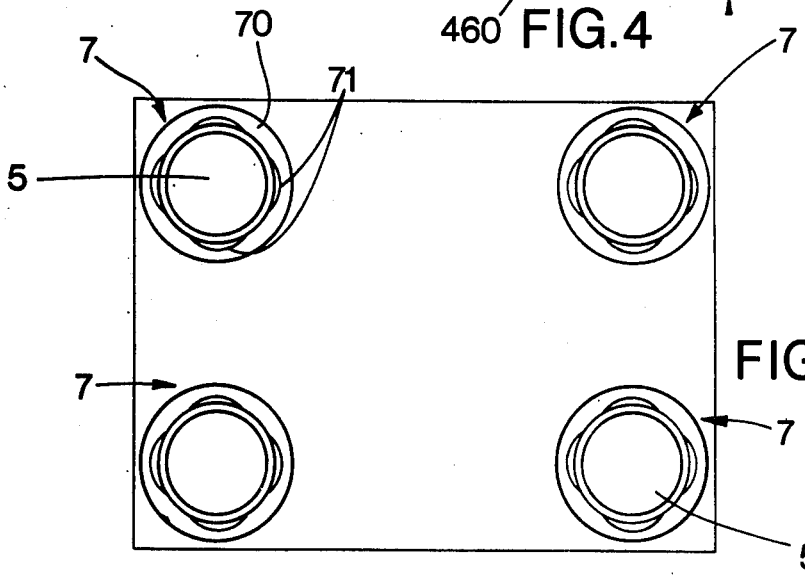

In practice constructions and arrangements of the forming apparatus as a press are as follows, reference being had to the accompanying drawings in which:

FIGS. 1 and 2 are diagrammatic elevational views each showing an alternative arrangement of the press, FIG. 3 is a hydraulic diagram applicable to either of the arrangements of FIGS. 1 and 2, FIG. 4 is a detail sectional view of a hydraulic restrictor, and FIG. 5 is a plan view showing guide pillar arrangement and linear hydrostatic bearings thereto.

Referring to FIG. 1, the support structure 1 of the machine provides a base 10 which carries one part 2 of the press tooling with a co-operating part 3 thereof carried by an overhead crosshead 4 arranged for up and down vertical outwith movement in relation to the base 10. For this purpose the crosshead 4 is carried by vertically movable guide pillars or pins 5 extending upwardly from a lower crosshead 6 housed within the support structure 1 of the press. The crossheads 4, 6 are thus rigidly connected with one another.

The pillars or pins 5 are slidably mounted in and through the base 10, by means of hydrostatic linear bearings 7 which arrangement not only ensures a high degree of accuracy in the movement of the crosshead 4 and hence in the registration of the press tooling 2, 3 used but also results in a low degree of friction in the vertical movement of the pillars 5 which is further in the interests of reliable high speed operation and a long serviceable life of the press.

Supply of hydraulic fluid such as a suitable oil to the pockets 71 of the bushes 70 of the bearings 7 and to other hydrostatic bearings of the press is hereinafter referred to with reference to FIGS. 3 to 5.

The lower crosshead 6 is operated for required vertical reciprocation by crank mechanism 11 shown consisting of a pair of laterally spaced apart connecting rods 12 pivoted about a transverse shaft 8 carried by the crosshead 6 and also pivotally connected to corresponding axially aligned and spaced apart crank pins 13 of a single crankshaft 14 journalled in the lower part of the support structure 1.

For providing a high degree of accuracy in the closing movement of the press tooling 2, 3 together for presswork purposes and also reducing friction, the crankshaft 14 is journalled in rotary hydrostatic bearings at 15 and likewise rotary hydrostatic bearings 16, 17 are provided at both ends of each connecting rod 12, i.e., about the shaft 8 and the crank pins 13 respectively. Interposed between the big end bearing 17 of each connecting rod 12 and the corresponding crank pin 13 is an eccentric bush 18 which is angularly adjustable and lockable for obtaining fine adjustment in the extent of vertical reciprocating movement of the crosshead and pillar assembly 4, 5 and 6 when setting up the press with the required tooling 2, 3.

In the arrangement shown in FIG. 2 one part of the tooling 22 is carried by a bed 20 at the lower part of the press, the co-operating tool 23 being carried by one crosshead portion 244 of an overhead crosshead 24 which is slidably mounted on fixed vertical guide pillars 25, carried by supporting structure 21 which in turn is mounted on the bed 20.

Accurate slidable mounting of the crosshead 24 on the pillars 25 is provided by hydrostatic linear bearings 27 carried by the crosshead 24. As, before the crosshead 24 is operated by crank mechanism 31 shown consisting of a pair of laterally spaced apart rods 32 pivoted about a transverse shaft 28 carried by the other crosshead portion 246 of the crosshead 24 and also pivoted about corresponding spaced apart axially aligned crankpins 33 of a crankshaft 34 journalled in an upper part of the supporting structure 21. The crosshead portions 244, 246 are thus rigidly connected with one another.

Also for maintaining required accuracy in the movement together of the press tooling 22, 23, the crankshaft 34 is journalled in rotary hydrostatic bearings 35 in the supporting structure 21 and rotary hydrostatic bearings 36, 37 are provided at both ends of the connecting rods 32 where they are respectively pivoted about the transverse shaft 28 and crankpins 33 of the crankshaft 34.

In a similar manner to that shown in FIG. 1, an eccentric bush 38 is shown interposed between the big end bearing 37 of each connecting rod 32 about the corresponding crankpin 33 for obtaining fine adjustment in the vertical movement of the crosshead 24.

The above-mentioned crank drives 11, 31 of the movable crossheads 4, 24 are advantageous in practice in providing simple and robust mechanism for the purpose, and also enable rotary hydrostatic bearings, 15, 16, 17, 35, 36, 37 to be employed in maintaining a high degree of accuracy throughout the working parts of the press.

Referring to FIG. 3, supply of hydraulic oil to the pockets 71, 151, 161 and 171 of the hydrostatic bearings 7, 15, 16 and 17 of FIG. 1 is provided by a pump 41 which delivers oil from a sump 40 in the base of the press via a filter 42 to manifold blocks 43, 44 from which the oil passes on permanently open circuit to the bearings 7 and 15, 16 and 17 respectively through restrictors 48 which latter may be of the capillary tube type of suitable length.

In the case of the crankshaft journal bearings 15, the supply from the appropriate manifold block is preferably by rigid pipeline while the connections to the connecting rod bearings 16, 17 is by means of flexible hoses which latter connections are preferably between a supply pipe and a manifold block 44 carried by the connecting rod with the restrictors 48 interposed between the manifold block 44 and the corresponding pockets 161, 171 of the bearings 16, 17.

In the case of the arrangement of FIG. 2, similar hydraulic oil supply is provided to the pockets 271, 351, 361 and 371 of the hydrostatic bearings 27, 35, 36 and 37, flexible hose connections being provided to the connecting rod bearings 36 and 37 and also to the bodily movable linear bearings 27.

In order to avoid coils of capillary restrictor tubing 48 to the bearings 16, 17 or 36, 37 being subject to dynamic loading as the connecting rods 12, 32 reciprocate at high speed (and similarly in the case of the bearings 27) a suitable form of restrictor is shown in FIG. 4, in which the inlet supply into the manifold block 44 communicates with a bore 45 in the latter receiving a plug 46, a portion 460 of the plug 46 which closely fits in the bore 45 having a spiral peripheral groove 480 of small cross section so that restricted oil flow is obliged to take place along the groove 480. The resistance to flow may be varied by varying the effective length of the plug portion 460.

Flexible hose connections are preferably duplicated with automatic closing valves at their end connections to minimize damage to the mechanism in the event of hose failure.

After flowing into the bearings 7, 15, 16, 17 or 27, 35, 36, 37, the oil spills from the ends of the bearing bushes 70, 150, 160, 170 or 270, 350, 360, 370 and returns to the sump 40 for re-circulation by the pump 41.

More particularly, in the case of a fixed manifold block such as that to the crankshaft journal bearings 15, 35, the block may incorporate control valves for the hydraulic control of auxiliary mechanisms (not shown) of the press.

In the case of the linear bearings 7, 27, the clearance in the latter may be greater than anticipated machining variation and in providing or adjusting restrictors 48 to the bearings 7, 27 of the four pillars 5, 25 shown in FIG. 5, the fluid flow rate and pressure to each bearing is adjusted by balancing the rates and pressures between the bearings using a pre-set flow condition of one of the bearings as an arbitrary basis for this purpose.

A similar procedure is adopted in the case of the crankshaft support bearings 15, 35 where, for example, the outer bearing restrictors are adjusted first followed by appropriate adjustment of the restrictors to the central or intermediate bearing support 115 or 135 so that a balanced condition of bearing support of the crankshaft 14, 34 is obtained.

Whereas capillary tube restrictors or a restrictor as shown in FIG. 4 can be readily employed, it is to be understood that any known or suitable form of variable or adjustable restrictor can be used for the purpose of this invention.

By the use of hydrostatic bearings in a press in the manner herein described a high degree of accuracy in the operation of the press can be maintained because the oil film created under operating conditions in the bearings provide accurate location without wear and also substantially reduces friction. In particular, the provision of the hydrostatic bearings in the reciprocating or crank mechanism enables more constant working clearances to be maintained throughout the mechanism and the accumulation of tolerance errors of the kind which arise in conventional presses, is greatly minimized.

The facility whereby the linear hydrostatic bearing guidance of the press tooling can be balanced is also advantageous in practice while a further benefit resides in much quieter operation of the press.

I claim:

1. Forming apparatus comprising a support structure; a bed fixedly carried by said support structure for carrying a first part of form tooling; crosshead means consisting of two crosshead portions rigidly connected with one another, one of said crosshead portions being adapted to carry a second complementary part of form tooling for co-operation with said first part thereof; shaft means mounted on the second of said crosshead portions; linear motion hydrostatic bearing means mounting said crosshead means for guided reciprocation thereof relative to the support structure and for accurate registration of the co-operating form tooling parts; a single crankshaft rotatably mounted in the support structure and having a pair of spaced apart axially aligned eccentric crank pins; a pair of laterally spaced apart connecting rods each rotatably mounted about a corresponding crank pin of the crankshaft by respective rotary hydrostatic bearing means, the other ends of the connecting rods being pivotally connected by respective further rotary hydrostatic bearing means to the shaft means of said second of said crosshead portions, whereby synchronized reciprocation of the connecting rods is obtainable in imparting reciprocation to the crosshead means, the spacing apart of the crank pins and of the connecting rods being sufficient to impart reciprocation to the crosshead means in a balanced manner.

2. Forming apparatus according to claim 1 wherein each crank pin of the crank shaft receives a bush eccentrically disposed about said crank pin, said bush receiving rotatably mounted about it one end of a corresponding connecting rod by rotary hydrostatic bearing means between said connecting rod and bush, the bush being angularly adjustable about the crank pin for obtaining adjustment in the extent of reciprocal movement of said connecting rod and said crosshead means.

3. Forming apparatus according to claim 1 wherein said second of the crosshead portions carries a single shaft about which said other ends of the connecting rods are pivotally connected to said shaft common thereto by said further respective rotary hydrostatic bearing means.

4. Forming apparatus according to claim 1 wherein said single crankshaft is rotatably supported by rotary hydrostatic bearing means in the support structure.

5. Forming apparatus according to claim 1 wherein said crosshead means further includes guide rods rigidly connected between said crosshead portions thereof, said linear hydrostatic bearing means being carried by said support structure and slidably receiving said guide rods.

6. Forming apparatus according to claim 1 wherein said one crosshead portion of said crosshead means for carrying a second complementary part of form tooling is movable with respect to said support structure and relative to said bed, said bed being carried by an upper part of the support structure.

7. Forming apparatus according to claim 1 wherein the linear hydrostatic bearing means is carried by the crosshead means and slidably engages guide rods fixed in the support structure.

* * * * *